US007000954B2

(12) United States Patent
Cohrs, Jr. et al.

(10) Patent No.: US 7,000,954 B2
(45) **Date of Patent: *Feb. 21, 2006**

(54) MIDRAIL MOUNTED EXIT DEVICE

(75) Inventors: Richard Bettin Cohrs, Jr., New Palestine, IN (US); Eric K. Arthur, Brownsburg, IN (US); Marlin Austin, Speedway, IN (US); Loren D. Mueller, Indianapolis, IN (US)

(73) Assignee: Dor-O-Matic, Inc., Harwood Heights, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/871,988

(22) Filed: Jun. 18, 2004

(65) Prior Publication Data

US 2004/0227353 A1 Nov. 18, 2004

Related U.S. Application Data

(62) Division of application No. 10/233,333, filed on Aug. 30, 2002, now Pat. No. 6,769,723.

(51) Int. Cl.
*E05B 65/10* (2006.01)

(52) U.S. Cl. ..... 292/92; 292/DIG. 65

(58) Field of Classification Search ..... 292/92, 292/93, DIG. 65; 49/141
See application file for complete search history.

(56) References Cited

U.S. PATENT DOCUMENTS

| | | | | |
|---|---|---|---|---|
| 145,116 A | | 12/1873 | McKiernan | |
| 1,359,391 A | | 11/1920 | Landymore et al. | |
| 1,891,588 A | | 12/1932 | Claus | |
| 2,251,031 A | | 7/1941 | Bozeman, Jr. | |
| 2,678,226 A | | 5/1954 | Wright | |
| 2,794,217 A | | 6/1957 | Croft | |
| 2,903,283 A | | 9/1959 | Sweetland | |
| 3,582,122 A | | 6/1971 | Foster | |
| 3,614,145 A | | 10/1971 | Zawadzki | |
| 3,643,478 A | | 2/1972 | McPeake | |
| 3,663,047 A | * | 5/1972 | Zawadzki | 292/92 |
| 3,730,574 A | | 5/1973 | Zawadzki | |
| 3,767,238 A | | 10/1973 | Zawadzki | |
| 3,854,763 A | | 12/1974 | Zawadzki et al. | |
| 3,913,263 A | | 10/1975 | Butt | |
| 4,081,219 A | | 3/1978 | Dykmans | |
| 4,083,590 A | | 4/1978 | Folger | |
| 4,130,269 A | | 12/1978 | Schreyer | |

(Continued)

FOREIGN PATENT DOCUMENTS

GB 2161201 1/1986

(Continued)

OTHER PUBLICATIONS

Dor-O-Matic 1390 Series Mid-Panel Concealed Vertical Rod Exit Device General information, dated Mar. 1989.

(Continued)

*Primary Examiner*—Gary Estremsky
(74) *Attorney, Agent, or Firm*—Michael Best & Friedrich LLP

(57) ABSTRACT

An exit device for a door having a first stile, a second stile, and a midrail coupled to the first and second stiles and defining a cutout. The exit device comprises a latching mechanism positioned in the cutout. A pushbar positioned in the cutout encloses the latching mechanism and has a front surface. The front surface is positionable in an extended position and a depressed position. The front surface defines a plurality of apertures which communicate with the latching mechanism. A lid slideably engages the front surface and has a closed position and an open position. The lid covers the plurality of apertures in the closed position.

16 Claims, 11 Drawing Sheets

U.S. PATENT DOCUMENTS 4,167,280 A 9/1979 Godec et al.
4,225,163 A 9/1980 Hubbard et al.
4,340,196 A 7/1982 Eldred
4,368,905 A 1/1983 Hirschbein
4,458,928 A 7/1984 Hirschbein
4,488,378 A 12/1984 Symon
4,560,192 A 12/1985 Wilson et al.
4,601,499 A 7/1986 Kim
4,624,120 A 11/1986 Hoffman et al.
4,677,814 A 7/1987 Anderson et al.
D295,606 S 5/1988 Ault
4,741,563 A 5/1988 Cohrs
4,799,422 A 1/1989 Birt
4,836,485 A 6/1989 Cooper
4,839,988 A * 6/1989 Betts et al. ..... 49/141
4,949,505 A 8/1990 Cohrs
4,961,330 A 10/1990 Evans
5,011,199 A 4/1991 Lowe et al.
5,018,690 A 5/1991 Widmer
5,024,472 A 6/1991 Cohrs
5,031,945 A 7/1991 Toledo
5,042,851 A 8/1991 Hunt
5,042,852 A 8/1991 Vitt et al.
5,067,757 A 11/1991 Cohrs et al.
5,085,475 A 2/1992 Austin et al.
5,114,192 A 5/1992 Toledo et al.
5,154,454 A 10/1992 Hollaway
5,169,185 A 12/1992 Slaybaugh et al.
5,340,095 A 8/1994 Eicher, III
5,364,140 A 11/1994 Rice
5,372,394 A 12/1994 Salter et al.
5,412,961 A 5/1995 Cain et al.
5,450,697 A 9/1995 Prucinsky et al.
5,464,259 A 11/1995 Cohrs et al.
5,609,371 A 3/1997 Mader et al.
5,639,129 A 6/1997 Lindley
5,673,949 A 10/1997 Mader et al.
5,673,883 A 11/1997 Cohrs et al.
5,682,778 A 11/1997 Cohrs et al.
5,762,385 A 6/1998 Mader et al.
5,765,957 A 6/1998 Connell
5,832,980 A 11/1998 Cianciolo
5,904,384 A 5/1999 Mader et al.
5,927,765 A 7/1999 Austin et al.
6,000,733 A 12/1999 Linder
6,009,732 A 1/2000 Haeck et al.
D425,810 S 5/2000 Siller et al.
6,076,384 A 6/2000 Thielmann et al.
6,108,975 A 8/2000 Bailey
D430,786 S 9/2000 Hickman et al.
D433,307 S 11/2000 Hickman et al.
D434,339 S 11/2000 Siller et al.
6,145,897 A 11/2000 Locher
6,205,825 B1 3/2001 Haeck et al.
6,233,877 B1 5/2001 Monroe
6,304,177 B1 10/2001 Nigro, Jr. et al.
6,316,892 B1 11/2001 Valencia
D451,359 S 12/2001 DePass
6,386,597 B1 5/2002 Walsh, III
6,394,508 B1 5/2002 Zehrung
6,409,232 B1 6/2002 Nigro, Jr. et al.
6,485,066 B1 11/2002 Nigro, Jr. et al.
6,609,575 B1 8/2003 Crabb
6,619,708 B1 9/2003 Naylor
6,697,719 B1 2/2004 Stouffer et al.
6,769,723 B1 * 8/2004 Cohrs, Jr. et al. ..... 292/92
D496,577 S 9/2004 Cohrs, Jr. et al.
6,820,905 B1 * 11/2004 Haeck et al. ..... 292/93
2002/0157317 A1 10/2002 Valencia et al.
2003/0028299 A1 2/2003 Stouffer et al.
2004/0041411 A1 3/2004 Cohrs, Jr. et al.

FOREIGN PATENT DOCUMENTS

GB 2245326 1/1992
JP 10339059 12/1998

OTHER PUBLICATIONS

NT Dor-O-Matic Greendale 1390 Mid-Panel Exit Device Parts List, Field Disassembly, and Reassembly Manual "Front Load", dated Jan. 1997.
Kawneer Installation Paneline/Panic Guard Exit Device Service & Adjustment Instructions, dated Feb. 1997.
Dor-O-Matic Exit Device Condensed Catalog, pp. 1-6, dated Feb. 2002.
Von Duprin Impact 94 and 95 Series Exit Devices with a copyright date of 2000.

* cited by examiner

MIDRAIL MOUNTED EXIT DEVICE

CROSS REFERENCE TO RELATED APPLICATIONS

The present application is a divisional application of application Ser. No. 10/233,333, filed Aug. 30, 2002 now U.S. Pat. No. 6,769,723.

FIELD OF THE INVENTION

The present invention relates generally to exit devices, and more particularly to a method and apparatus for securing a door with the exit device.

BACKGROUND OF THE INVENTION

A variety of exit devices are commonly used with conventional doors. Typically, doors include an inactive stile and an active stile. Generally, the inactive stile is connected to a doorframe with hinges so that the door can move between open and closed positions. In certain applications, the active stile houses vertically concealed rods and latches, which extend into and retract out of the doorframe to lock and unlock the door. A midrail generally extends between the active and inactive stiles. Exit devices are commonly installed in a recess in the midrail and therefore have a relatively low profile, which provides a more aesthetically pleasing door. This is particularly desirable in applications in which the exit devices are installed on the front or in the entryway of public buildings. The relatively low profile of the exit devices also reduces the presence of the exit device in the door opening, maximizing the opening available for travel through the doorframe which is particularly desirable in cases such as handicap access. Additionally, the relatively low profile of the exit devices reduces the exposure of the exit device to contact and thus potential for damage.

A large number and variety of people, including the handicapped, children, and the elderly operate conventional exit devices. Additionally, exit devices are commonly designed to be easy to operate to provide rapid building egress during emergencies, such as, for example, during a fire or a natural disaster. For these and other reasons, many conventional exit devices include a pushbar, which is located between two end caps. To open and/or unlock the door, a person simply depresses the pushbar.

Typically, exit devices and doors are purchased separately and the exit device is installed in the door immediately before or even after the door has been installed in the doorframe. Generally, the exit device is installed in the midrail adjacent to the active stile and a filler is used to enclose the remaining portion of the midrail that is generally adjacent to the inactive stile. Accordingly, if the filler or the recess in the midrail is incorrectly sized, the exit device may not fit properly in the midrail and may not operate correctly because of interference between moving parts in the exit device. Conventional exit devices have attempted to minimize the potential for interference by minimizing the travel distance of the moving parts in the exit device and the midrail or filler. In particular, conventional exit devices are often designed to minimize the projection of the internal latching mechanism in the dogged or extended position, which in turn reduces the mechanical advantage that can be achieved by depressing the pushbar.

Exit devices are generally installed on the left or right-hand sides of doors depending upon the swing of the door and the entryway. It is therefore desirable for exit devices to be able to be usable in either a right-hand or a left-hand application. In addition to the above mentioned design considerations, exit devices that are easy to manufacture, easy to assemble, durable, and inexpensive are highly desirable for obvious reasons.

SUMMARY OF THE INVENTION

According to the present invention, an exit device for a door having a midrail extending between a first stile, a second stile, and defining a cutout comprises a latching mechanism positioned in the cutout and a pushbar enclosing the latching mechanism. The pushbar has a front surface and is positioned in the cutout. The pushbar has a depressed position and an extended position. The front surface defines a plurality of apertures, which communicate with the latching mechanism. The exit device further comprises a lid, which slideably engages the front surface, substantially covering the plurality of apertures.

In some embodiments, the exit device includes a plurality of sides extending from the front surface into the cutout. The sides and the front surface define a first end and a second end. End caps are removeably coupled to the first and second ends for movement with the pushbar between the extended position and the depressed position. The exit device includes a base plate. A cover is coupled to the base plate and has an outer surface, which is sloped upwardly from the midrail toward the end cap. A portion of the cover is substantially flush with the front surface when the pushbar is in the depressed position.

The latching mechanism includes a control rod, which is substantially parallel to the front surface and a bell crank coupled to the control rod and the pushbar. The latching mechanism has a left-hand orientation and a right-hand orientation and includes a base and a lift arm coupled to the base in a first position when the latching mechanism is in the left-hand orientation and in a second position when the latching mechanism is in the right-hand orientation. The exit device includes an actuator for moving the latching mechanism between a locked position and an unlocked position. Alternatively or in addition, the exit device can include a base and a dogging mechanism having a hook, which is coupled to the base for rotation between a latched position and an unlatched position.

A securing mechanism for securing the exit device in the midrail includes a shaft having a first end and a second end and defining a longitudinal axis. A bracket is coupled to the exit device and defines a first aperture and a second aperture. The first end of the shaft extends through the first aperture and the second end of the shaft extends through the second aperture. A first anchor is slideably coupled to the shaft and is moveable along the longitudinal axis between a first locked position and a first unlocked position. The first anchor frictionally engages the door in the first locked position. A second anchor is slideably coupled to the shaft and is moveable along the longitudinal axis between a second locked position and a second unlocked position. The second anchor frictionally engages the door in the second locked position.

The present invention also includes a method of securing the exit device in a door. The method comprises inserting the exit device into the cutout, accessing the securing mechanism through the plurality of apertures, rotating the shaft in a first direction about the longitudinal axis, moving the first anchor along the shaft toward the first end, moving the second anchor along the shaft toward the second end, and applying a compressive force to the midrail with the first and second anchors to hold the exit device and the securing mechanism in the door. In some applications, the pushbar includes a cover which slideably engages the front surface and the method further comprises removing the lid from the front surface.

Additional features and advantages of the invention will become apparent to those skilled in the art upon consideration of the following detailed description, claims, and drawings.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION

Figure 1:
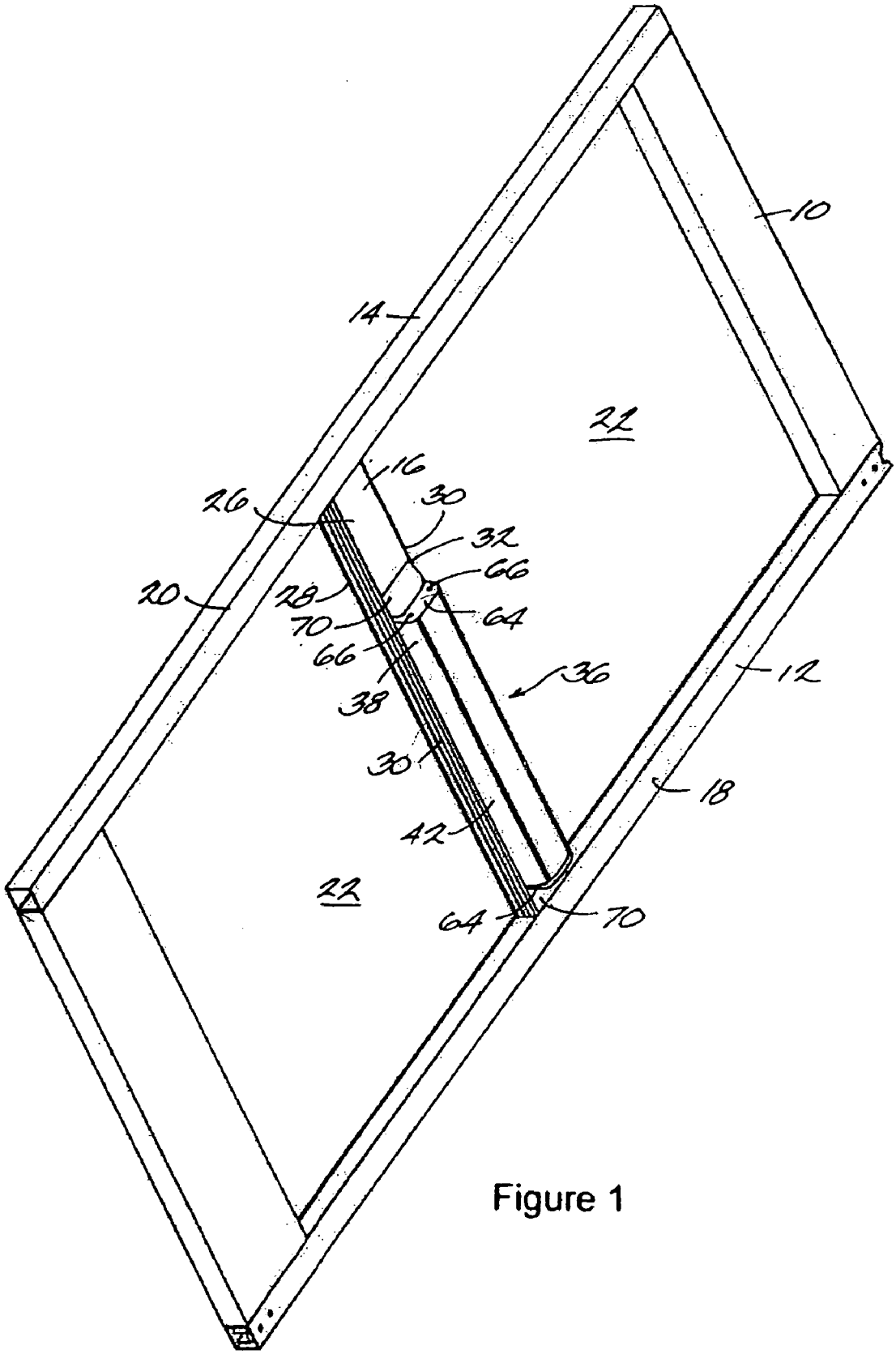
FIG. 1 is a perspective view of a door having an exit device embodying the present invention.
Figure 2:
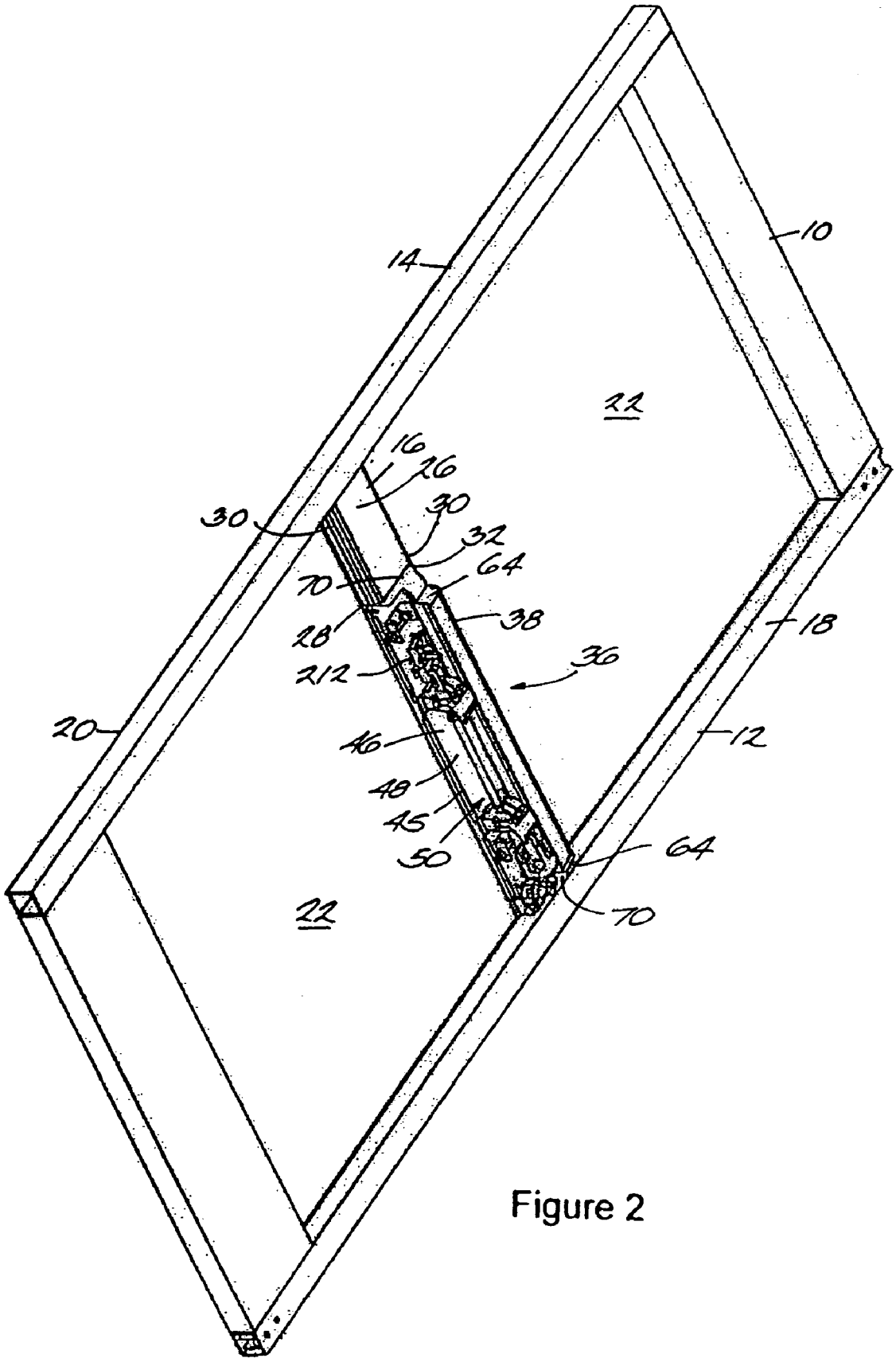
FIG. 2 is a perspective view, with parts broken away, of the door and the exit device of FIG. 1.
Figure 3:
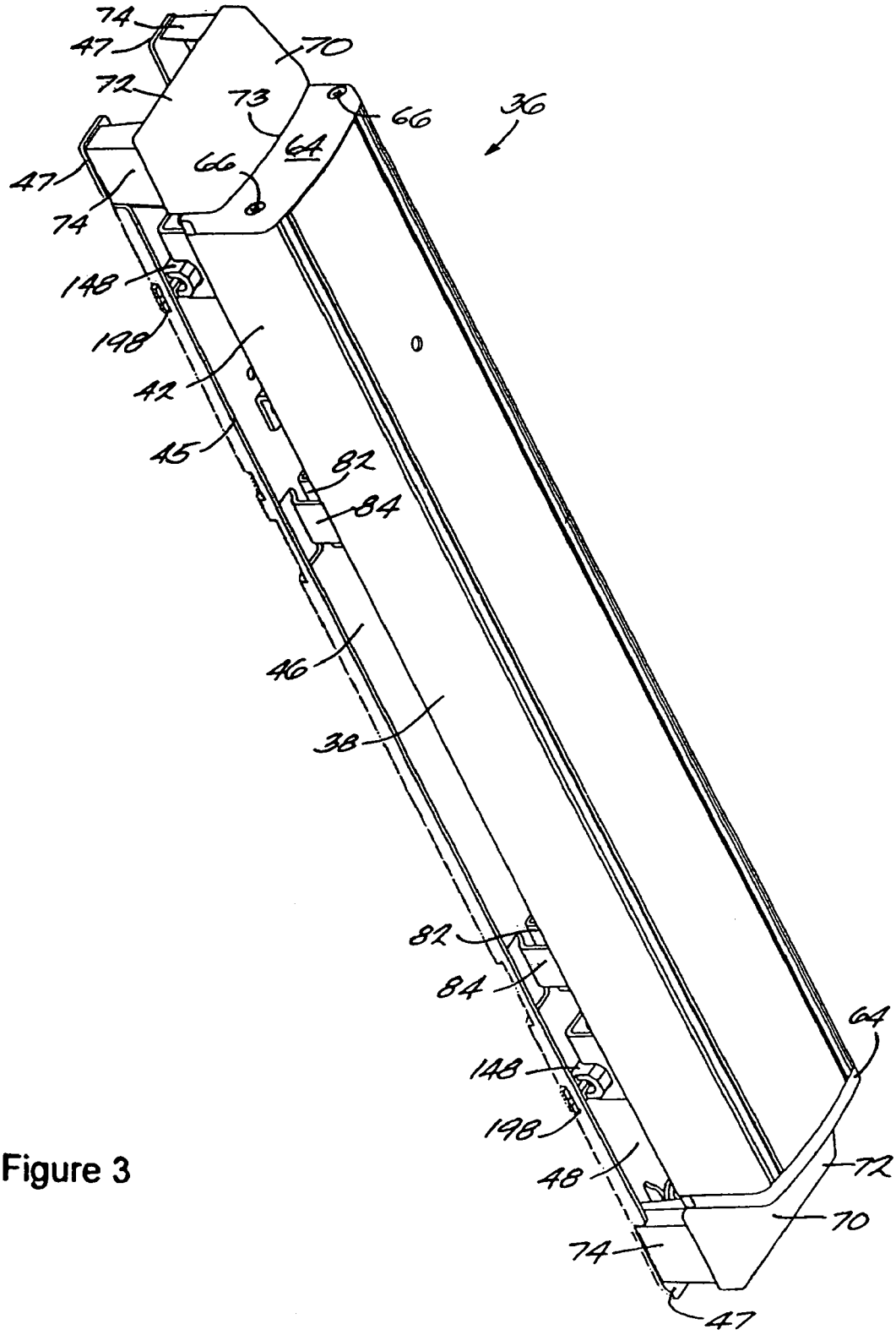
FIG. 3 is an enlarged perspective view of the exit device of FIG. 1.

FIGS. 1 and 2 illustrate a door 10 including an active stile 12 positioned at one side and an inactive stile 14 positioned at the other side. The active stile 12 at least partially encloses a vertical rod and latch set 15 (partially shown in FIG. 4). Hinges (not shown) pivotably couple the inactive stile 14 to a doorframe (not shown). A midrail 16 extends between the inactive stile 14 and the active stile 12 and divides the door 10 into an upper portion 18 and a lower portion 20. In the illustrated embodiment, the upper and lower portions 18, 20 include transparent glass panels 22. However, one having ordinary skill in the art will appreciate that other materials commonly used in doors, including opaque and translucent materials, such as, for example, wood, steel, aluminum, and the like can also or alternately be used. Additionally, the term "midrail" as used herein and in the appended claims is meant to be illustrative and is not meant to indicate placement of the midrail 16 with respect to the door 10. Also, the midrail 16 can, but does not necessarily, divide the door 10 into equally sized upper and lower portions 18, 20. The midrail 16 includes a filler plate 26, a back 28, and a pair of sides 30 generally perpendicular to the filler plate 26 and the back 28. Together, the sides 30 and the back 28 define a cutout or recessed portion 32, which extends into the midrail 16.

An exit device 36 is located in the cutout 32 and includes a U-shaped pushbar 38, having a front face 40 (FIG. 5) that is generally parallel to the filler plate 26, sides 42 that are perpendicular to the front face 40 and extend into the cutout 32, and open ends 44. Together, the pushbar 38 and a base plate 46 define an interior space 48, which, at least partially, encloses a latching mechanism 50. In the illustrated embodiment, the latching mechanism 50 is a latch releasing mechanism which cooperates with vertical rod and latch set 15 to lock and unlock the door 10. However, one having ordinary skill in the art will appreciate that the present invention can also be used with other locking latch sets 15 that are commonly used in doors 10. Alternatively, the present invention can be used independently to lock and unlock doors 10. As explained in greater detail below, when the pushbar 38 is depressed, the latching mechanism 50 is moved from a locked to an unlocked position so that the door 10 can be opened.

Figure 5:
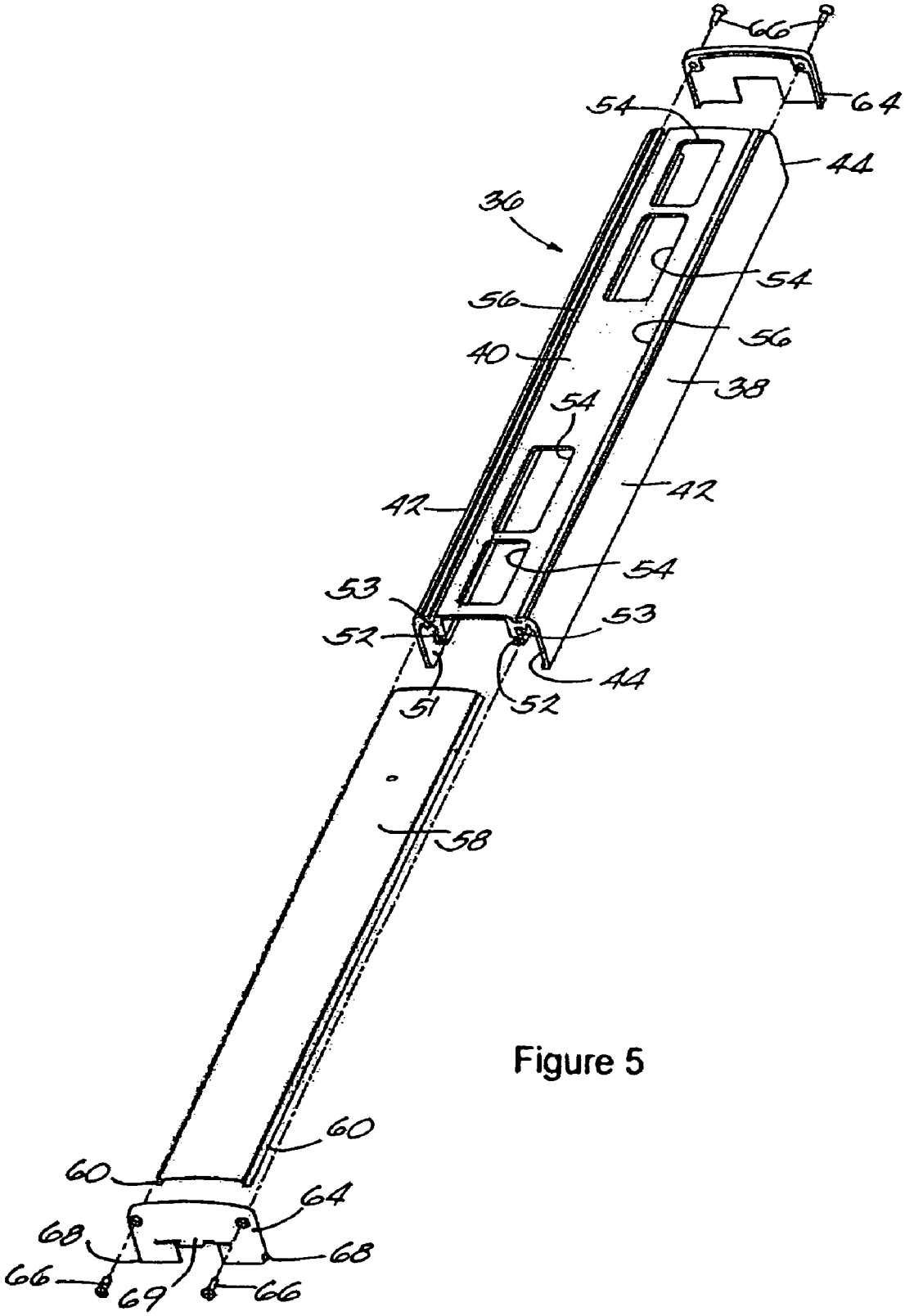
FIG. 5 is an exploded perspective view of a portion of the exit device of FIG. 1.

The base plate 46 has a generally rectangular shape. Two upturned walls or ribs 45 extend laterally along the length of the base plate 46, adding strength and rigidity to the exit device 36. Positioning tabs 47 extend outwardly from the base plate 46 and serve to position the base plate 46 in the midrail 16 in a desired position with respect to the active stile 12, the cutout 32, and the filler plate 26. With reference to FIG. 5, an interior surface 51 of the pushbar 38 includes two substantially parallel notched legs 52 that extend along the length of the pushbar 38 between the open ends 44. Two bores 53 extend laterally into the pushbar 38 adjacent to the notched legs 52.

The front face 40 defines four generally rectangular apertures 54, which communicate with the interior space 48, providing ready accesses to the latching mechanism 50 to simplify installation and maintenance of the exit device 36. In the illustrated embodiment, the apertures 54 are equal in size and are spaced equidistantly from the sides 42 to simplify manufacture and assembly of the exit device 36. However, one having ordinary skill in the art will appreciate that the size, shape, and placement of the apertures 54 can be changed to a significant degree without departing from the spirit and scope of the present invention.

The pushbar 38 also includes two substantially L-shaped rails 56, which extend longitudinally along opposite sides of the front face 40. A cover plate or lid 58 having laterally extending legs 60 which matingly engage the L-shaped rails 56 is slideably coupled to the front face 40 of the pushbar 38, covering the apertures 54 and providing an aesthetically pleasing appearance for the front of the exit device 36. In the illustrated embodiment, the legs 60 fit relatively tightly in the rails 56, preventing the cover plate 58 from moving or rattling once it is installed in the pushbar 38.

End caps 64 are coupled to the ends 44 of the pushbar 38 with fasteners 66, which are threaded into the bores 53. The end caps 64 hold the cover 58 in position on the pushbar 38 and protect the latching mechanism 50. In the illustrated embodiment, the fasteners 66 are flat Phillips head screws, which are countersunk into the end caps 64. However, in other applications other fasteners (e.g., bolts, rivets, pins, keys, and the like) can also or alternately be used. Each end cap 64 includes two raised pads 68, which prevent the pushbar 38 from rubbing against the sides 30 of the midrail 16 as the pushbar 38 is moved between the depressed and extended positions. The end caps 64 also include tongues 69, which extend inwardly toward the base plate 46 and then curve outwardly away from the pushbar 38.

Fixed covers 70 are coupled to the base plate 46 on opposite sides of the pushbar 38 adjacent to the end caps 64 and are sized to cooperate with the end caps 64 to enclose the interior space 48. Outer surfaces 72 of the fixed covers 70 are sloped downward and away from the end caps 64 so that when the pushbar 38 is depressed, interior sides 73 (FIGS. 6 and 9) of the outer surfaces 72 are flush with the front face 40 of the pushbar 38, thereby protecting the latching mechanism 50. This arrangement is particularly desirable in applications in which the latching mechanism 50 is frequently in the unlocked position and the pushbar 38 is in the depressed position, such as, for example, in stores that maintain their doors 10 unlocked during business hours. In these cases, the fixed covers 70 protect the pushbar 38 and the latching mechanism 50 from potentially damaging lateral impact, which can occur when, for example, a shopping cart is pushed into the exit device 36.

Protrusions 74 (FIGS. 6 and 9) are symmetrically spaced on the interior surfaces of the fixed covers 70 and extend inwardly toward the base plate 46. Fasteners 76 are threaded through the positioning tabs 47 on the base plate 46 and into blind holes in the protrusions 72 to couple the fixed covers 70 to the base plate 46. In the illustrated embodiment, the fasteners 76 are Phillips undercut flat head screws. However, in other applications other fasteners (e.g., bolts, rivets, pins, keys, and the like) can also or alternately be used. The fixed covers 70 also include inwardly extending protuberances 77, two of which are substantially parallel and extend inwardly from each of the fixed covers 70 toward the base plate 46.

Figure 6:
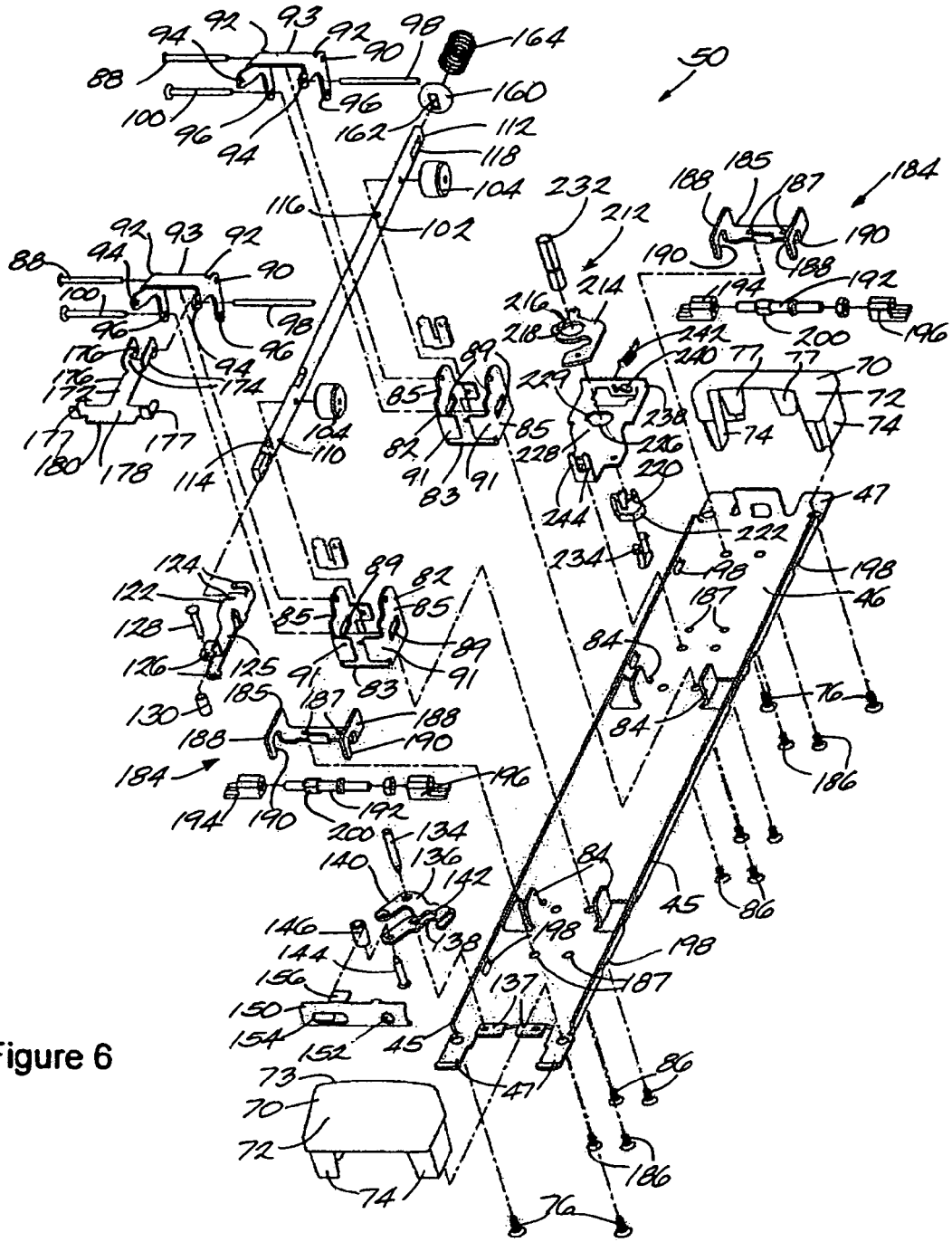
FIG. 6 is an exploded perspective view of a portion of the exit device of FIG. 1.
Figure 7:
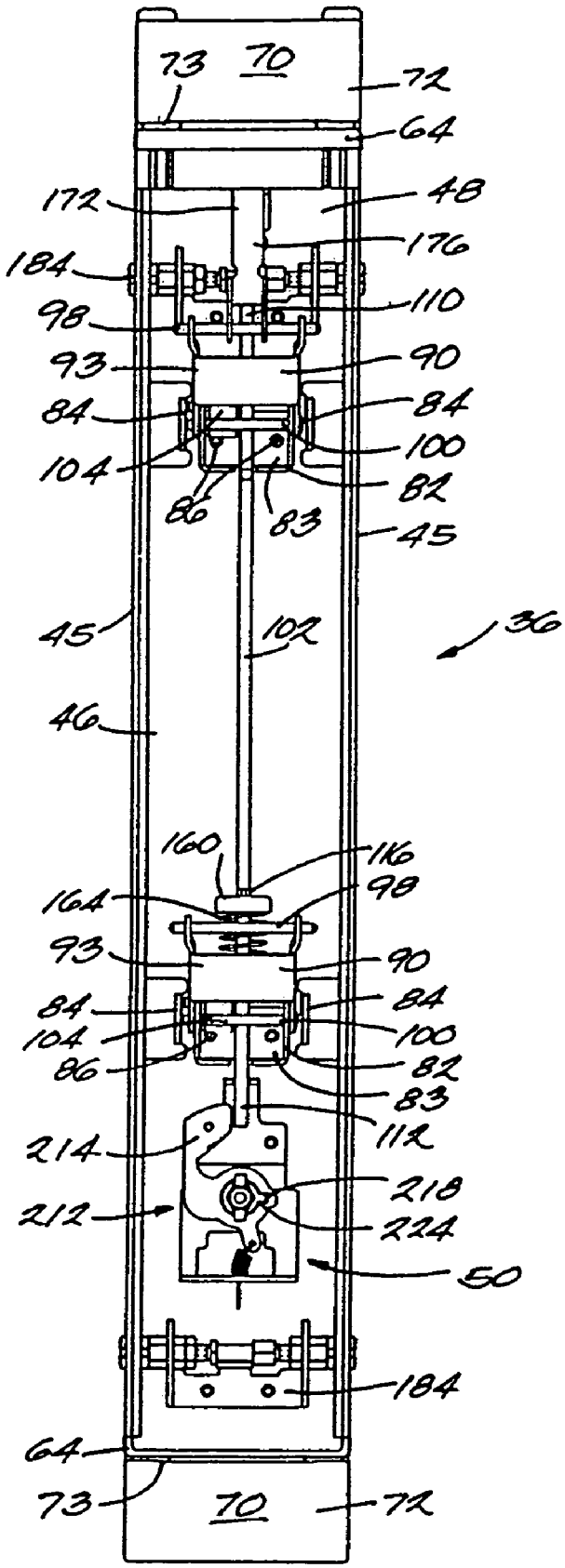
FIG. 7 is a front view, with parts broken away, of the exit device of FIG. 1.
Figure 8:
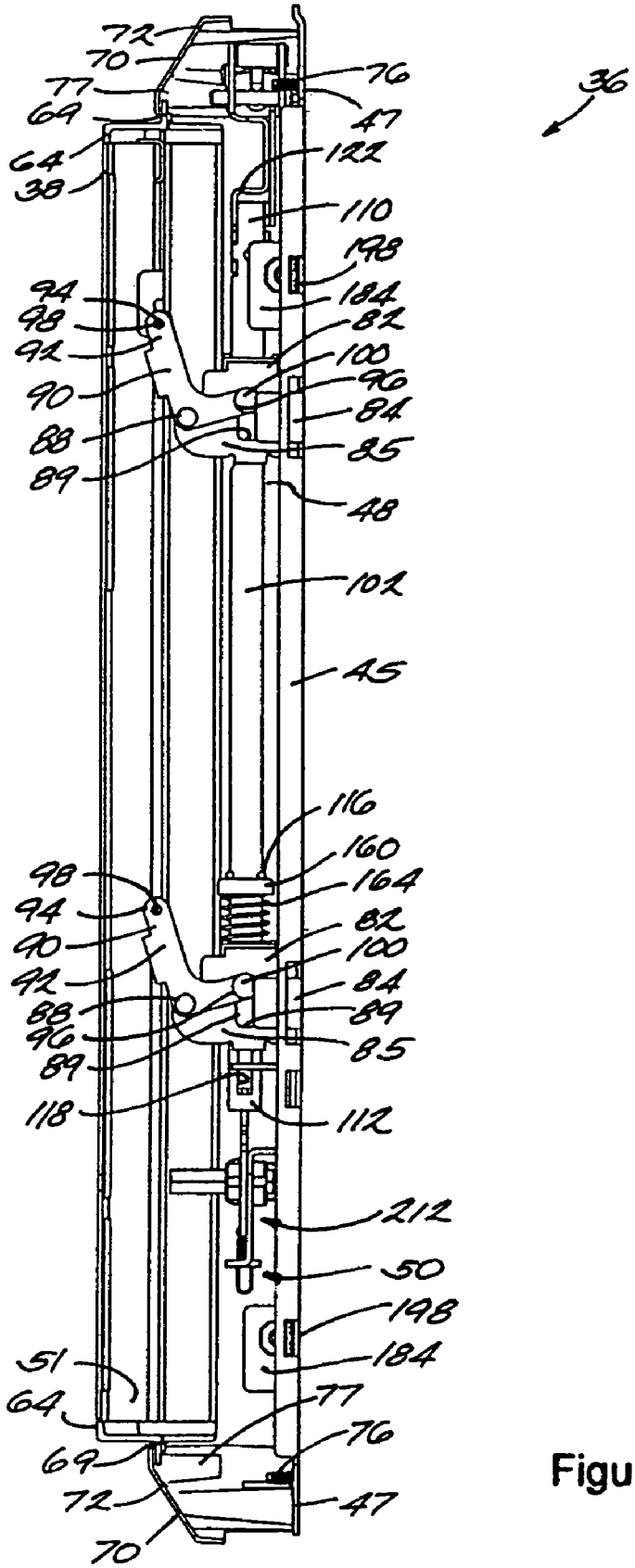
FIG. 8 is a top view, with parts broken away, of the exit device of FIG. 1.
Figure 9:
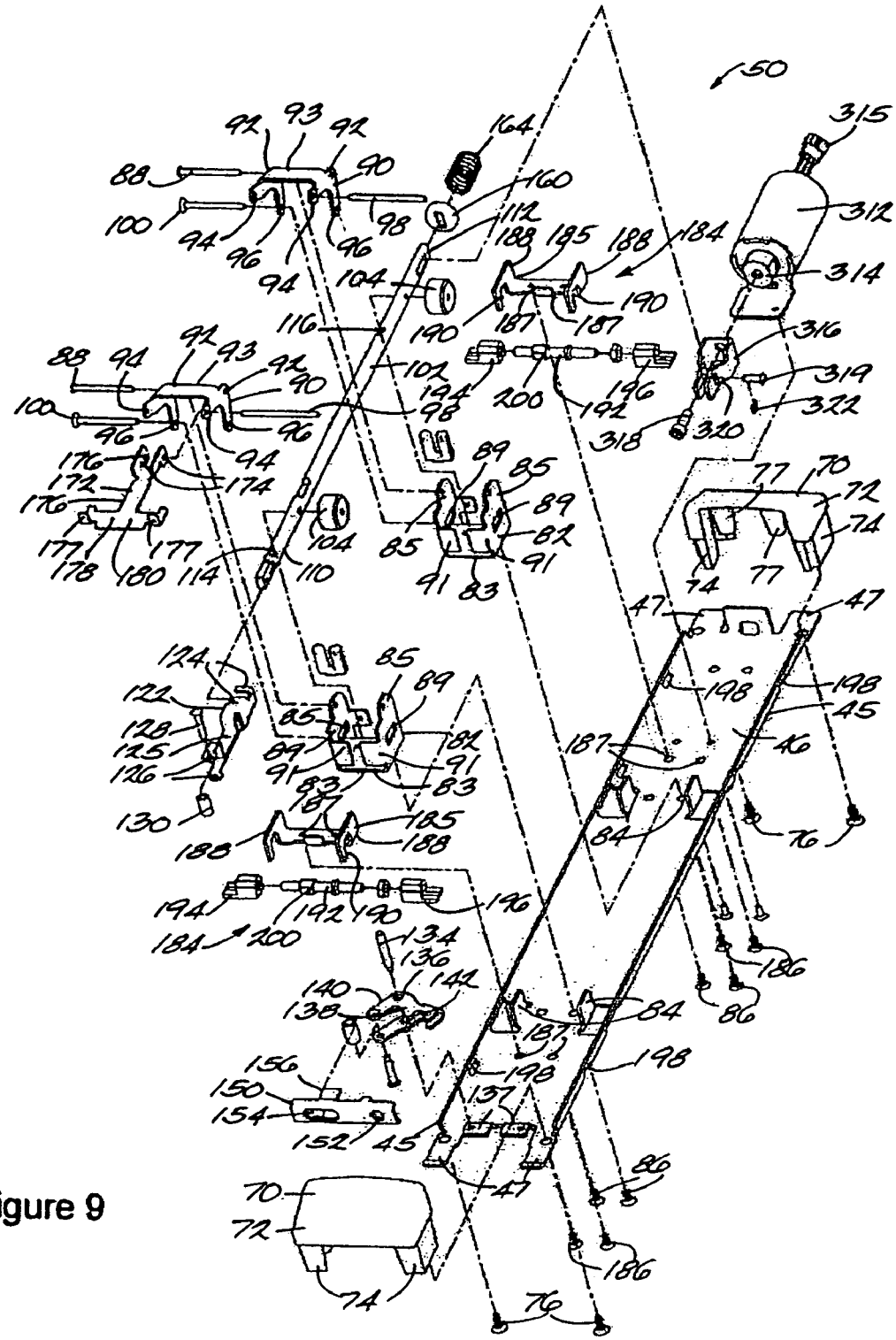
FIG. 9 is an exploded perspective view, with parts broken away, of an exit device according to another embodiment of the present invention.

Referring now to FIGS. 6 and 9, the latching mechanism 50 includes two U-shaped bell crank brackets 82, having recessed central sections 83. Fasteners 86 extend through the base plate 46 and into central sections 83, coupling the bell crank brackets 82 to the base plate 46 between positioning tabs 84, which extend outwardly from the base plate 46. Each of the brackets 82 includes two legs 85, which extend away from the base plate 46 between the positioning tabs 84 and include slots 89. Stop tabs 91 extend inwardly from the legs 85 in a direction substantially parallel to the central sections 83. Bell crank axles 88 pivotably couple bell cranks 90 to the bell crank brackets 82. In the illustrated embodiment, the bell crank axles 88 are conventional oval head rivets. However, in other applications other fasteners (e.g., bolts, screws, pins, keys, and the like) can also or alternately be used.

Each of the bell cranks 90 includes two substantially parallel L-shaped legs 92, which are connected by straps 93 and include first ends 94 and second ends 96. Pushbar pins 98 extend though the first ends 94 and into the notched legs 52 on the pushbar 38, pivotably and slideably connecting the pushbar 38 and the bell cranks 90 so that when the pushbar 38 is depressed, the bell cranks 90 pivot about the bell crank axles 88. Control pins 100 pivotably couple the second ends 96 to opposite ends of a control rod 102 and extend through the slots 89 in the bell crank brackets 82. The tabs 84 also hold the control pins 100 in the second ends 96, preventing the control pins 100 from coming loose during installation and operation of the exit device 36. The control pins 100 also extend through cylindrical bumpers 104, which are preferably made of natural rubber or another similar commercially available elastic material (e.g., plastic, nylon, and the like). Additionally, the first ends 94 of the L-shaped legs 92 rest against the interior surface of the pushbar 38 so that the pushbar 38 is centered with respect to the bell cranks 90.

When the pushbar 38 is depressed toward the base plate 46, the bell cranks 90 pivot about their respective bell crank axles 88 and move the control rod 102 in a direction substantially parallel to the base plate 46. Lateral movement of the control rod 102 is constrained by the bell crank brackets 82. More particularly, when the pushbar 38 is depressed, the control pins 100 are moved laterally along the length of the slots 89 and the bumpers 104 are compressed against the stop tabs 91, preventing the pushbar 38 from being pressed beyond a predetermined point. Preferably, the bumpers 104, the stop tabs 91, and the slots 89 are sized and positioned to prevent the control pins 100 from contacting the ends of the slots 89 when the pushbar 38 is fully depressed, thereby minimizing the generation of noise.

The control rod 102 extends longitudinally through the exit device 36 between the bell crank brackets 82 in a direction substantially parallel to and between the pushbar 38 and the base plate 46. In the illustrated embodiment, the control rod 102 has a substantially rectangular cross section. However, in other embodiments (not shown), the control rod 102 can have any number of different shapes and configurations. For example, the control rod 102 can have a circular cross section, a square cross section, a pentagonal cross section, a hexagonal cross section, and the like. The control rod 102 includes a first end 110 and a second end 112. When the latching mechanism 50 is in the locked position, the first end 110 is adjacent to the active stile 12 and when the latching mechanism 50 is in the unlocked position, the control rod 102 is moved laterally away from the active stile 12. The first end 110 includes two parallel notches 114, which extend through the control rod 102 in a direction substantially parallel to the base plate 46 and perpendicular to the length of the control rod 102. The second end 112 includes a rectangular slot 118.

Referring now to FIGS. 6 and 9, a latch control bracket 122 includes four fingers 124 which extend in a direction substantially parallel to the length of the control rod 102 and engage the notches 114, coupling the latch control bracket 122 to the first end 110 of the control rod 102. In some applications, the fingers 124 can be bent or formed around the control rod 102 to more securely and permanently couple the latch control bracket 122 to the first end 110 of the control rod 102. A central relief area 125 of the latch control bracket 122 extends under one of the end caps 64 between the pads 68 toward the active stile 12. The central relief area 125 has a relatively low profile and therefore does not contact the end caps 64 when the pushbar 38 is depressed. Two coaxial apertures 126 extend through the latch control bracket 122, supporting a latch control axle 128. A latch control roller 130 is held on the latch control axle 128 by the latch control bracket 122 and is rotatable about the latch control axle 128. In the illustrated embodiment, the latch control axle 128 is an oval head rivet. However, in other applications other fasteners (e.g., bolts, screws, pins, keys, and the like) can also or alternately be used.

A lift arm axle 134 pivotably couples a lift arm 136 to the base plate 46 adjacent to the active stile 12. More specifically, the lift arm axle 134 couples the lift arm 136 to one of a number of tabs 137, which extend upwardly and away from the base plate 46. In the illustrated embodiment, two tabs 137 are positioned between the positioning tabs 47, providing two different mounting locations for the lift arm 136 so that the installer can adjust or field hand the lift arm 136 after the exit device 36 has been installed in the midrail 16 to accommodate differences in the relative location of the vertical rod and latch set 15 with respect to the cutout 32 (e.g., whether or not the exit device 36 is mounted on the left or right-hand sides of the door 10). Other embodiments of the present invention (not shown) can include any number of tabs 137, giving one, three, four, or more different mounting locations for the lift arm 136 and the lift arm axle 134.

The lift arm 136 pivots about the lift arm axle 134 and cooperates with the latch control bracket 122, acting as a bell crank. The lift arm 136 is substantially L-shaped, having a first leg 138 and a second leg 140. The first leg 138 includes a notch 142, which is contoured to engage the latch control roller 130. The second leg 140 supports a lift arm roller axle 144 and a lift arm roller 146, which is rotatably mounted thereon. In the illustrated embodiment, the lift arm roller axle 144 is a countersunk head rivet. However, in other applications other fasteners (e.g., bolts, screws, pins, keys, and the like) can also or alternately be used. The lift arm 136 is prevented from pivoting beyond a predetermined distance by one of the protrusions 74 on the fixed cover 70.

Figure 4:
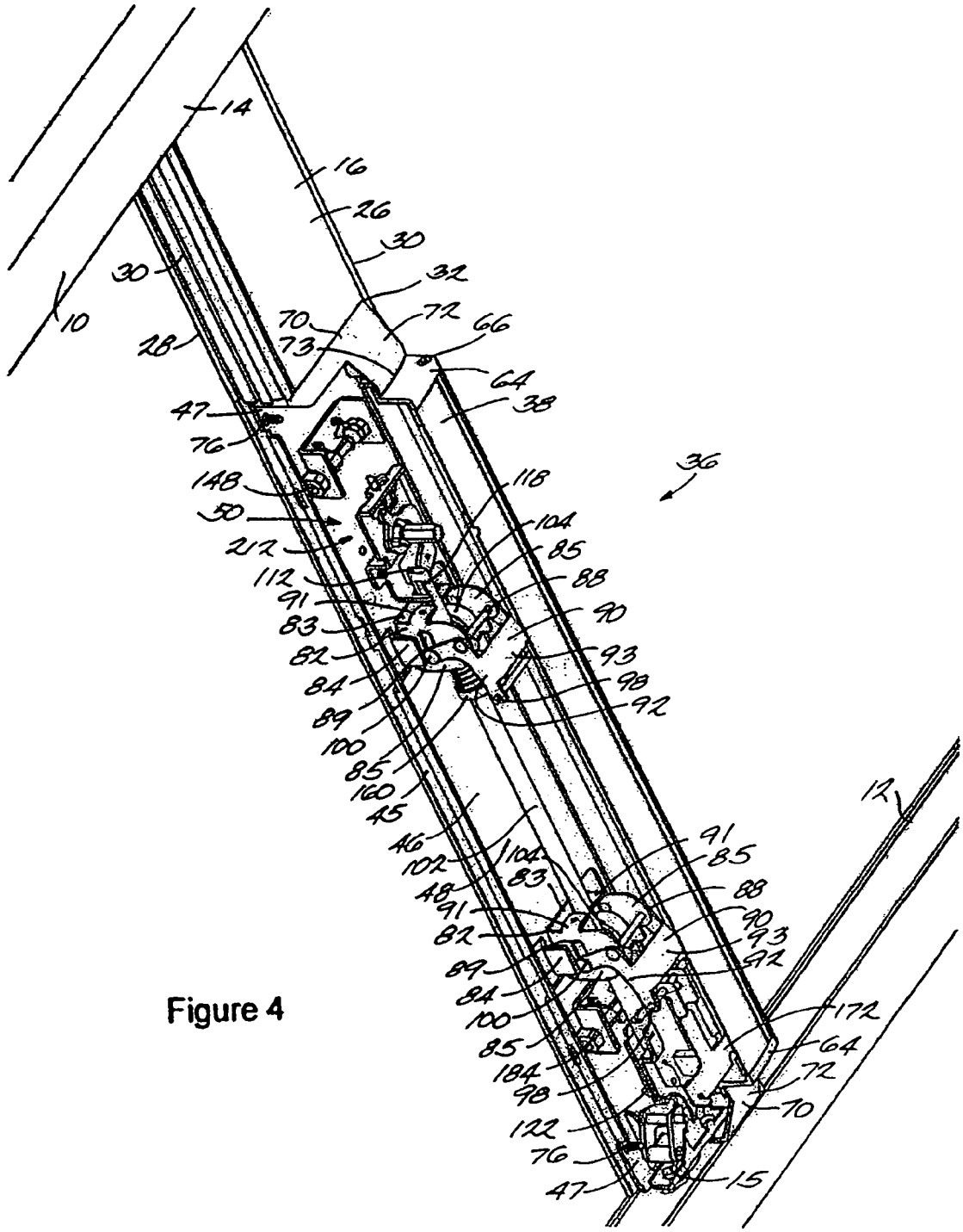
FIG. 4 is an enlarged perspective view, with parts broken away, of the exit device of FIG. 1.

As shown in FIGS. 6 and 9, a lift bracket 150 is coupled to one of the fixed covers 70 adjacent to the active stile 12 and engages the vertical rod and latch set 15 (FIG. 4). The lift bracket 150 has a semi-circular cross section and includes a circular aperture 152 for engagement with the top rod (not shown) of the vertical rod and latch set 15 and a slotted aperture 154 for engagement with the bottom rod (not shown) of the vertical rod and latch set 15. The dual engagement with the vertical rod and latch set 15 provided by the combination of the circular aperture 152 and the slotted aperture 154 provides additional security to the latching mechanism 50 and makes forced entry more difficult. Tabs 156 extend inwardly from the lift bracket 150 toward the control rod 102. The lift arm roller 146 engages the bottom of the tabs 156 and applies an upward force to the lift bracket 150 to lift the vertical rod and latch set 15. Vertical movement of the lift bracket 150 is limited by the protrusions 74, which extend inwardly from the active side of the fixed cover 70 and prevent the lift bracket 150 from traveling upward beyond a predetermined point or downward below a predetermined point.

In operation, when the pushbar 38 is depressed, the bell cranks 90 move the control rod 102 and the latch control bracket 122 laterally away from the active stile 12. As the latch control bracket 122 moves laterally, the latch control roller 130 causes the lift arm 134 to pivot about the lift arm axle 134. As the lift arm 136 pivots about the lift arm axle 134, the lift arm roller 146 applies an upward force to the tabs 156. When the lift bracket 150 is moved upward to a predetermined position, the lift arm bracket 150 releases the vertical rod and latch set 15 so that the door 10 can be opened.

A substantially cylindrical spring stop 160 having a centrally located cutout 162 (FIGS. 6 and 9) is positioned on the second end 112 of the control rod 102. The cutout 162 rests against the tabs 116, which prevent the spring stop 160 from moving along the control rod 102 toward the first end 110. In the illustrated embodiment, the spring 164 is a helical compression spring. However, in other embodiments, other springs (e.g., leaf springs, coil springs, and the like) can also or alternately be used. A first end of the spring 164 rests against an interior surface of the spring stop 160. A second end of the spring 164 rests against the tabs 91 in the bell crank bracket 82. Therefore, the spring 164 biases the control rod 102 toward an extended position, which maintains the latching mechanism 50 in the locked position until the pushbar 38 is depressed.

A generally T-shaped pushbar bracket 172 is connected to the pushbar 38 and one of the bell cranks 90 with one of the pushbar pins 98. Two upturned legs 174 extend outwardly from a base portion 176 of the pushbar bracket 172. The pushbar pin 98 extends through an aperture 176, which extends through the two upturned legs 174. Two top legs 177 extend outwardly from an upper portion 178 of the pushbar bracket 172. The pushbar bracket 172 also includes a pad 180, which is positioned between the two top legs 177. The two top legs 177 and the pad 180 are captured between the pushbar 38 and one of the end caps 64, preventing the bell crank 90 from moving laterally with respect to the pushbar 38.

Two securing mechanisms 184 are coupled to the base plate 46 with fasteners 186, which extend through apertures 187 in the base plate 46. The securing mechanisms 184 hold the exit device 36 in the midrail 16 by applying compressive force to the sides 30 of the cutout 32. In other embodiments (not shown), one, three or more securing mechanisms 184 can also or alternately be used to secure the exit device 36 in the midrail 16. The securing mechanisms 184 include a generally U-shaped bracket 185, having outwardly extending legs 188, which define apertures 190. A rotatable shaft 192 extends through the apertures 190 and is threadably coupled to a first anchor 194 and a second anchor 196. When the exit device 36 is installed in the cutout 32, the shaft 192 is rotated about its own axis, causing the first and second anchors 194, 196 to move outwardly through apertures 198 in the upturned walls 45 and engage the midrail 16. To facilitate rotation, the shaft 192 includes an operator 200, which includes one or more flat surfaces so that a wrench or another similar tool (not shown) can grasp and turn the shaft 192. Once the exit device 36 has been installed in the midrail 16, an installer can access the securing mechanisms 184 through the apertures 54 in the pushbar 38 by removing the cover plate 58. In this manner, the installer can tighten or loosen the securing mechanisms 184 as needed.

With reference to FIGS. 1–8, a first embodiment of the present invention includes a dogging device 212, which assists in the retraction and extension of the control rod 102 between the extended and the retracted positions, thereby cooperating with the rest of the latching mechanism 50 to hold the exit device 36 in the unlocked position. The dogging device 212 is similar to the controller described in U.S. Pat. No. 5,927,765, issued Jul. 27, 1999, which is hereby incorporated by reference.

Generally, the dogging device 212 includes a dogging hook 214, which is rotatable into and out of engagement with the rectangular slot 118 in the control rod 102. When the dogging hook 214 engages the rectangular slot 118, the dogging hook 214 holds the control rod 102 in a retracted position and maintains the pushbar 38 in the depressed position. When the dogging hook 214 releases the control rod 102, the pushbar 38 moves outwardly away from the base plate 46.

The dogging hook 214 includes a central aperture 216 and a keyway 218 for keyed engagement with a generally cylindrical adapter 220, which has a shoulder portion 222 at its base and an axially extending key 224 for engaging a central aperture 226 in a dogging plate 228. The central aperture 226 includes a limiting keyway 229, which accommodates limited rotation of the adapter 220 with respect to the dogging plate 228. The adapter 220 includes a central aperture, which matingly engages an operator 232. In the illustrated embodiment the central aperture and the operator 232 are hexagonal. However, one having ordinary skill in the art will appreciate that the operator 232 and the central aperture 230 can have other shapes (e.g., square, round, D-shaped, and the like). A U-shaped spring or clip 234 axially engages and matingly connects the dogging hook 214, the adapter 220, and the operator 232, holding the dogging device 212 together.

One end of the dogging plate 228 includes an upturned portion 238 with a cutout 240 for attachment of one end of a spring 242. The other end of the dogging plate 228 includes fingers 244, which restrain the lateral movement of the control rod 102. The other end of the spring 242 is coupled to the dogging hook 214 and biases the dogging hook 214 and the control rod 102 in the engaged position.

Figure 10:
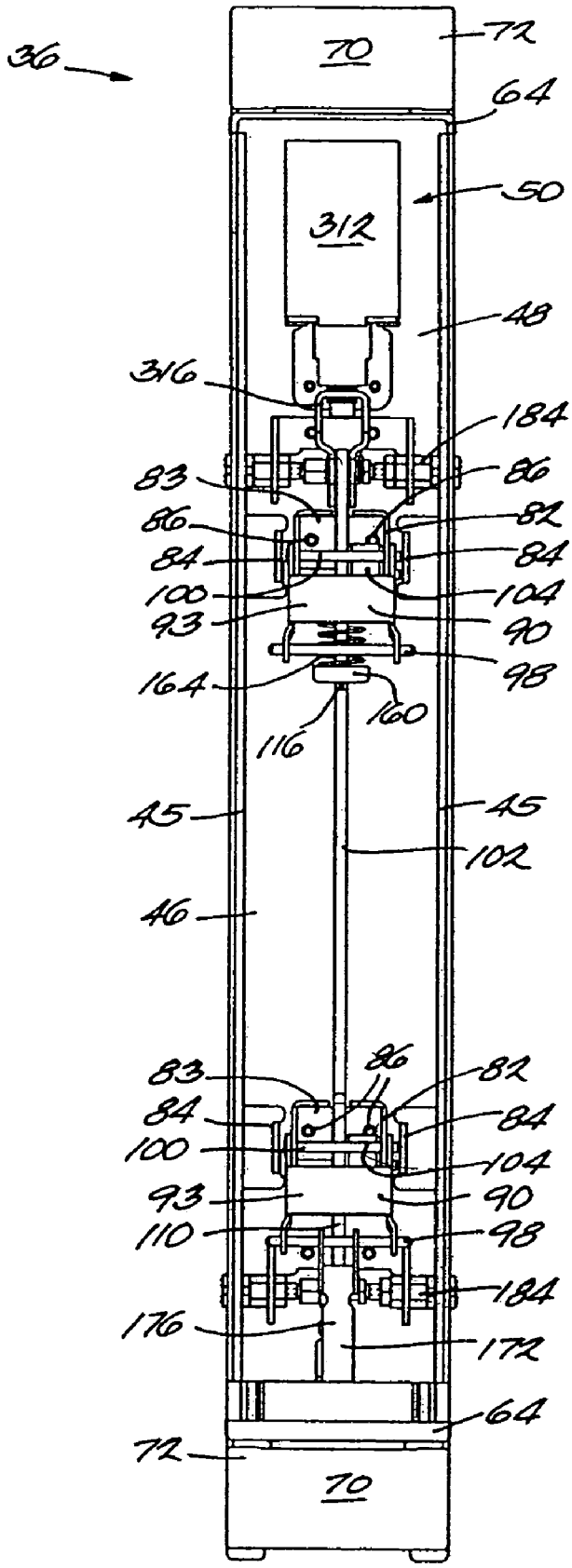
FIG. 10 is a front view, with parts broken away, of the exit device of FIG. 9.
Figure 11:
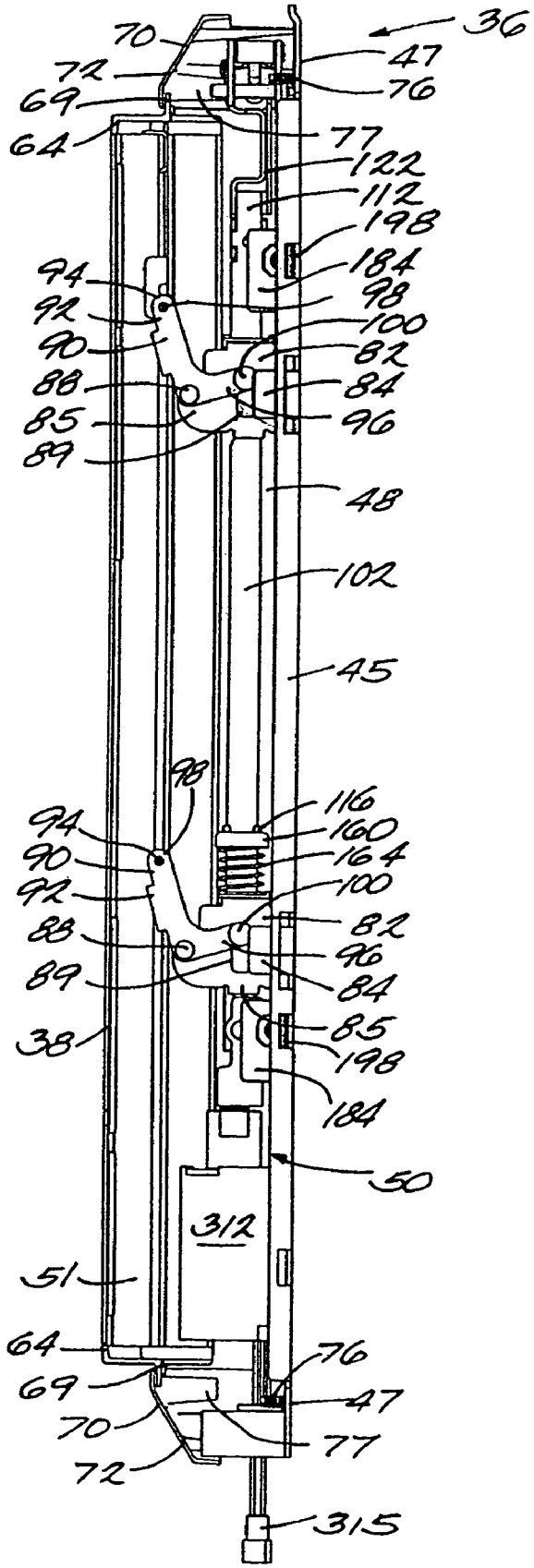
FIG. 11 is a top view, with parts broken away, of the exit device of FIG. 9.

Referring now to FIGS. 9–11, a second embodiment of the present invention includes an actuator 312, which assists in the retraction and extension of the control rod 102 between the extended or locked position and the retracted or unlocked position. In the illustrated embodiment, the actuator is a solenoid. However, one having ordinary skill in the art will appreciate that other actuators, including stepper motors and the like can also or alternately be used. The actuator 312 is fixedly coupled to the base 46 and includes a plunger 314 which extends and retracts based upon electrical signals received from a controller (not shown) via wires 315.

The plunger 314 is coupled to a link bracket 316 with a fastener 318. In the illustrated embodiment, the fastener 318 is a socket head cap screw. However, in other applications other fasteners (e.g., bolts, rivets, pins, keys, and the like) can also or alternately be used. The link bracket 316 is substantially U-shaped. A linkage pin 319 extends through apertures 320 in the link bracket 316 and the rectangular slot 118 in the control rod 102, fixedly coupling the link bracket 316 and the control rod 102. A retaining ring 322 (e.g., a snap-fit ring or a C-clip) holds the linkage pin 319 in the aperture 320.

The present invention also includes a method for installing the exit device 36 in the door 10. The exit device 36 is preferably sold as a modular assembly and is sized to be installed in a number of differently sized doors 10 having a number of differently sized midrails 16. Prior to installation, the filler plate 26 can be cut to change the size and shape of the cutout 32 to better accommodate the exit device 36. One of the end caps 64 is then removed from the pushbar 38 so that the cover plate 58 can be removed. In this manner, the installer can access the latching mechanism 50 and the securing mechanisms 184 through the apertures 54. The lift bracket 150 is then positioned in the cutout 32 over the vertical rod and latch set 15. The rest of the exit device 36 is then inserted into the cutout 32 so that the base plate 46 rests against the back 28 of the midrail 16 and so that two of the positioning tabs 47 are pressed against the active stile 12. Using a wrench (not shown) or another similar tool, the installer rotates the operators 200, extending the first and second anchors 194, 196 through the apertures 198 in the upturned walls 45 into engagement with the sides 30 of the midrail 16 so that the compressive force exerted by the securing mechanisms 184 holds the exit device 36 in the midrail 16. The cover plate 58 and the end cap 64 are then reinstalled on the pushbar 38. In a similar manner, the exit device 36 can be serviced or removed from the midrail 16.

The embodiments described above and illustrated in the drawings are presented by way of example only and are not intended as a limitation upon the concepts and principles of the present invention. As such, it will be appreciated by one having ordinary skill in the art, that various changes in the elements and their configuration and arrangement are possible without departing from the spirit and scope of the present invention as set forth in the appended claims. Also, the functions of the various elements and assemblies of the present invention can be changed to a significant degree without departing from the spirit and scope of the present invention.

What is claimed is:

1. An exit device having a latching mechanism for a door having a first stile, a second stile, and a midrail coupled to the first and second stiles, the midrail defining a cutout, the exit device comprising:

a latching mechanism positioned in the cutout and having a left-hand orientation and a right-hand orientation, the latching mechanism including a base, a control rod which is substantially parallel to the base, a bell crank coupled to the control rod and rotatably coupled to the base, and a lift arm coupled to the base in a first position when the latching mechanism is in the left-hand orientation and in a second position when the latching mechanism is in the right-hand orientation;

a pushbar enclosing the latching mechanism and extending into the cutout, the pushbar having an extended position and a depressed position; and a securing mechanism for securing the latching mechanism in the midrail, the securing mechanism including:

a shaft having a first end and a second end and defining a longitudinal axis;

a bracket coupled to the exit device, the bracket defining a first aperture and a second aperture, the first end of the shaft extending through the first aperture and the second end of the shaft extending through the second aperture;

a first anchor slideably coupled to the shaft and being moveable along the longitudinal axis between a first locked position and a first unlocked position, the first anchor frictionally engaging the door in the first locked position; and a second anchor slideably coupled to the shaft and being moveable along the longitudinal axis between a second locked position and a second unlocked position, the second anchor frictionally engaging the door in the second locked position.

2. An exit device having a latching mechanism for a door having a first stile, a second stile, and a midrail coupled to the first and second stiles, the midrail defining a cutout, the exit device comprising:

a latching mechanism positioned in the cutout and having a left-hand orientation and a right-hand orientation, the latching mechanism including a base, a control rod which is substantially parallel to the base, a bell crank coupled to the control rod and rotatably coupled to the base, and a lift arm coupled to the base in a first position when the latching mechanism is in the left-hand orientation and in a second position when the latching mechanism is in the right-hand orientation; and a pushbar enclosing the latching mechanism and extending into the cutout, the pushbar having an extended position and a depressed position;

wherein the pushbar includes a front surface and has an extended position and a depressed position, the front surface defining a plurality of apertures.

3. The exit device of claim 2, further comprising a lid slideably engaging the front surface and having a closed position and an open position, the lid covering the plurality of apertures in the closed position.

4. The exit device of claim 2, wherein the pushbar includes a plurality of sides which extend from the front surface into the cutout, the plurality of sides and the front surface defining an end and further comprising an end cap fixedly coupled to the end for movement with the pushbar between the extended position and the depressed position.

5. The exit device of claim 4, wherein the plurality of sides define a second end and further comprising a second end cap fixedly coupled to the end for movement with the pushbar between the extended position and the depressed position.

6. The exit device of claim 4, further comprising a cover coupled to the midrail and having an outer surface sloping upwardly from the midrail toward the end cap.

7. The exit device of claim 6, wherein a portion of the cover is substantially flush with the front surface when the pushbar is in the depressed position.

8. An exit device having a latching mechanism for a door having a first stile, a second stile, and a midrail coupled to the first and second stiles, the midrail defining a cutout, the exit device comprising:

a latching mechanism positioned in the cutout and having a left-hand orientation and a right-hand orientation, the latching mechanism including a base, a control rod which is substantially parallel to the base, a bell crank coupled to the control rod and rotatably coupled to the base, and a lift arm; and a pushbar enclosing the latching mechanism and extending into the cutout, the pushbar having an extended position and a depressed position;

wherein the base defines a first predetermined mounting location and a second predetermined mounting location, wherein, when the latching mechanism is in the left-hand orientation, the lift arm is coupleable to the base in the first predetermined mounting location, and wherein, when the latching mechanism is in the right-hand orientation, the lift arm is coupleable to the base in the second predetermined mounting location;

wherein the base includes an upper edge, and wherein the first mounting location is spaced a first distance from the upper edge and the second mounting location is spaced a second distance from the upper edge, the second distance being greater than the first distance.

9. The exit device of claim 8, wherein the base defines an outwardly extending tab, and wherein the outwardly extending tab defines the first predetermined mounting location.

10. An exit device having a latching mechanism for a door having a first stile, a second stile, and a midrail coupled to the first and second stiles, the midrail defining a cutout, the exit device comprising:

a latching mechanism positioned in the cutout and having a left-hand orientation and a right-hand orientation, the latching mechanism including a base, a control rod which is substantially parallel to the base, a bell crank coupled to the control rod and rotatably coupled to the base, and a lift arm; and a pushbar enclosing the latching mechanism and extending into the cutout, the pushbar having an extended position and a depressed position;

wherein the base defines a first predetermined mounting location and a second predetermined mounting location, wherein, when the latching mechanism is in the left-hand orientation, the lift arm is coupleable to the base in the first predetermined mounting location, and wherein, when the latching mechanism is in the right-hand orientation, the lift arm is coupleable to the base in the second predetermined mounting location;

wherein the pushbar includes a front surface defining a plurality of apertures.

11. The exit device of claim 10, wherein the lift arm is moveable between the first mounting location and the second mounting location after the latching mechanism is positioned in the cutout.

12. The exit device of claim 10, further comprising a lid slideably engaging the front surface and having a closed position and an open position, the lid substantially covering the plurality of apertures in the closed position.

13. The exit device of claim 10, wherein the pushbar includes a plurality of sides which extend from the front surface into the cutout, the plurality of sides and the front surface defining an end, and further comprising an end cap fixedly coupled to the end for movement with the pushbar between the extended position and the depressed position.

14. The exit device of claim 13, wherein the plurality of sides define a second end, and further comprising a second end cap fixedly coupled to the end for movement with the pushbar between the extended position and the depressed position.

15. The exit device of claim 13, further comprising a cover coupled to the midrail and having an outer surface sloping upwardly from the midrail toward the end cap.

16. The exit device of claim 15, wherein, when the pushbar is in the depressed position, a portion of the cover is substantially aligned with the front surface.

* * * * *